US006346677B1

(12) United States Patent
Guillemette et al.

(10) Patent No.: US 6,346,677 B1
(45) Date of Patent: Feb. 12, 2002

(54) HIGH-VOLTAGE BUSHING PROVIDED WITH EXTERNAL SHIELDS

(75) Inventors: Robert Guillemette, Bellefeuille; Bertrand Legrand, Saint-André, both of (CA)

(73) Assignee: Electro Composites, Inc., Saint-Jerome (CA)

( * ) Notice: Subject to any disclaimer, the term of this patent is extended or adjusted under 35 U.S.C. 154(b) by 0 days.

(21) Appl. No.: 09/391,738

(22) Filed: Sep. 8, 1999

(51) Int. Cl.[7] ..... H01B 17/26
(52) U.S. Cl. ..... 174/142; 174/144; 174/152 R
(58) Field of Search ..... 174/142, 144, 174/152 R

(56) References Cited

U.S. PATENT DOCUMENTS 3,643,003 A * 2/1972 Graybill ..... 174/142
4,104,497 A * 8/1978 Brealey ..... 174/142
4,159,860 A 7/1979 Broad ..... 339/60 M
4,272,642 A 6/1981 Classon ..... 174/31 R
4,296,274 A * 10/1981 Cookson ..... 174/142
4,426,547 A * 1/1984 Ogino ..... 174/142
4,431,859 A * 2/1984 Kishida ..... 174/142
4,458,101 A 7/1984 Cookson et al. ..... 174/31 R
4,477,692 A * 10/1984 Brealey ..... 174/142
4,584,429 A 4/1986 Raketti et al. ..... 174/18
4,670,625 A * 6/1987 Wood et al. ..... 174/152 R
4,774,385 A * 9/1988 Toshima ..... 174/142
4,980,515 A 12/1990 Sakuma et al. ..... 174/35 CE
5,130,495 A 7/1992 Thompson ..... 174/73.1
5,252,913 A 10/1993 Falkowski et al. ..... 324/127
5,466,891 A * 11/1995 Freeman et al. ..... 174/142
6,218,627 B1 * 4/2001 Shindo et al. ..... 174/142
6,255,589 B1 * 7/2001 Starck et al. ..... 174/142

* cited by examiner

*Primary Examiner*—Jeffrey Sterrett
(74) *Attorney, Agent, or Firm*—Selitto, Behr & Kim

(57) ABSTRACT

A high-voltage bushing for insulating a conductor going through a metallic wall is described herein. To allow a conventional current transformer to be used to monitor the current flowing through the conductor, an external shield is embedded in the tubular body of the bushing and electrically connected to the metallic wall. An internal shield, also embedded in the tubular body of the bushing and electrically connected to the conductor, is provided to prevent the electric field to generate high levels of partial discharge in the air surrounding the conductor in the tubular body.

11 Claims, 3 Drawing Sheets

HIGH-VOLTAGE BUSHING PROVIDED WITH EXTERNAL SHIELDS

FIELD OF THE INVENTION

The present invention relates to high-voltage bushings. More specifically, the present invention is concerned with a high-voltage bell bushing provided with external and internal shields used for switchgears, disconnect switches and other high-voltage related equipments.

BACKGROUND OF THE INVENTION

The use of high-voltage bushings to surround a conductor which extends through a metal plate is well known in the art. Since such bushings are primarily used to insulate the conductor from the conductive wall through which it extends, they are made of a dielectric material.

It is often desirable to position a current sensor, usually in the form of a current transformer, near the bushing to monitor the current flowing through the conductor.

FIG. 1 of the appended drawings schematically illustrates, in a partly sectional view, a conventional high-voltage bushing 10 mounted to the conductive wall 12 of an enclosure. As schematically illustrated by electric field lines 14 in this figure, the electric field is intense at the base of the bushing, where the current transformer 16 is mounted. Since this strong electric field would interfere with the operation of a conventional current transformer, a shielded current transformer must be used, which increases the overall cost of the bushing.

It has been found that a shield mounted directly to the bushing and connected to the metallic enclosure to which the bushing is mounted allows a conventional current transformer to be used without interference from the electric field that is deflected by the shield. The shields are often molded with the bushing near an external surface thereof.

FIG. 2 of the appended drawings, which is labelled "Prior Art", schematically illustrates a bushing 20 provided with an external shield 22 connected to the metallic wall 24 of the enclosure via the fastener 26.

As schematically illustrated by electric field lines 28 in this figure, the electric field is deflected from the area near the base of the bushing 20, thereby allowing a conventional current transformer 30 to be used.

It is to be noted that even though the shield 22 is schematically illustrated as a braided shield, it could advantageously be a capacitive shield made of a non-magnetic conductor material.

A major disadvantage of the bushing 20 is that the level of the electric field is very high in the air surrounding the conductor 34 which leads to high partial discharge levels in this area.

Another drawback of the bushing 20 is that the electric field goes through two dielectric material, i.e. the material forming the body 32 of the bushing and the air, having different dielectric properties which contributes to high partial discharges in the vicinity of the conductor.

OBJECTS OF THE INVENTION

An object of the present invention is therefore to provide an improved high-voltage bushing.

Another object of the invention is to provide a high-voltage bushing having both internal and external shield.

SUMMARY OF THE INVENTION

More specifically, in accordance with an embodiment of the present invention, there is provided a high-voltage bushing for insulating a conductor going through a metallic wall, the bushing comprising:

- a generally tubular body made of a dielectric material; the generally tubular body being configured and sized to be mounted to the metallic wall and to receive the conductor; the generally tubular body having an external surface and an internal surface;
- a generally tubular external shield embedded in the body near the external surface; the external shield being configured to be electrically connected to the metallic wall;
- a generally tubular internal shield embedded in the body near the internal surface; the internal shield being configured to be electrically connected to the conductor.

According to a preferred embodiment of the present invention, there is provided a high-voltage bushing for insulating a conductor going through a metallic wall, the bushing comprising:

- a generally tubular body made of a dielectric material; the generally tubular body being configured and sized to be mounted to the metallic wall and to receive the conductor; the generally tubular body having an external surface and an internal surface;
- a generally circular flange made of dielectric material and integrally formed with the generally tubular body;
- an outer insulating shell made of dielectric material and integrally formed with the flange; the outer insulating shell defining a series of skirts;
- a generally tubular external braided metallic shield embedded in the body near the external surface; the external shield being configured to be electrically connected to the metallic wall via at least one metallic fastener used to mount the flange to the metallic wall; and
- a generally tubular internal braided metallic shield so embedded in the body near the internal surface as to be coaxial with the external shield; the internal shield being configured to be electrically connected to the conductor; the internal shield being longer than the external shield and being provided with an outwardly flaring distal end.

Other objects, advantages and features of the present invention will become more apparent upon reading of the following non restrictive description of preferred embodiments thereof, given by way of example only with reference to the accompanying drawings.

DESCRIPTION OF THE PREFERRED EMBODIMENT

Generally stated, the present invention overcomes the drawbacks of the prior art related to the mounting of an external shield electrically connected to the enclosure to which the bushing is mounted by mounting an internal shield electrically connected to the conductor in order to prevent high levels of electric field in the vicinity of the conductor. This allows a conventional current transformer to be used as a current sensor without generating extreme electrical conditions in the air surrounding the conductor.

Figure 1:
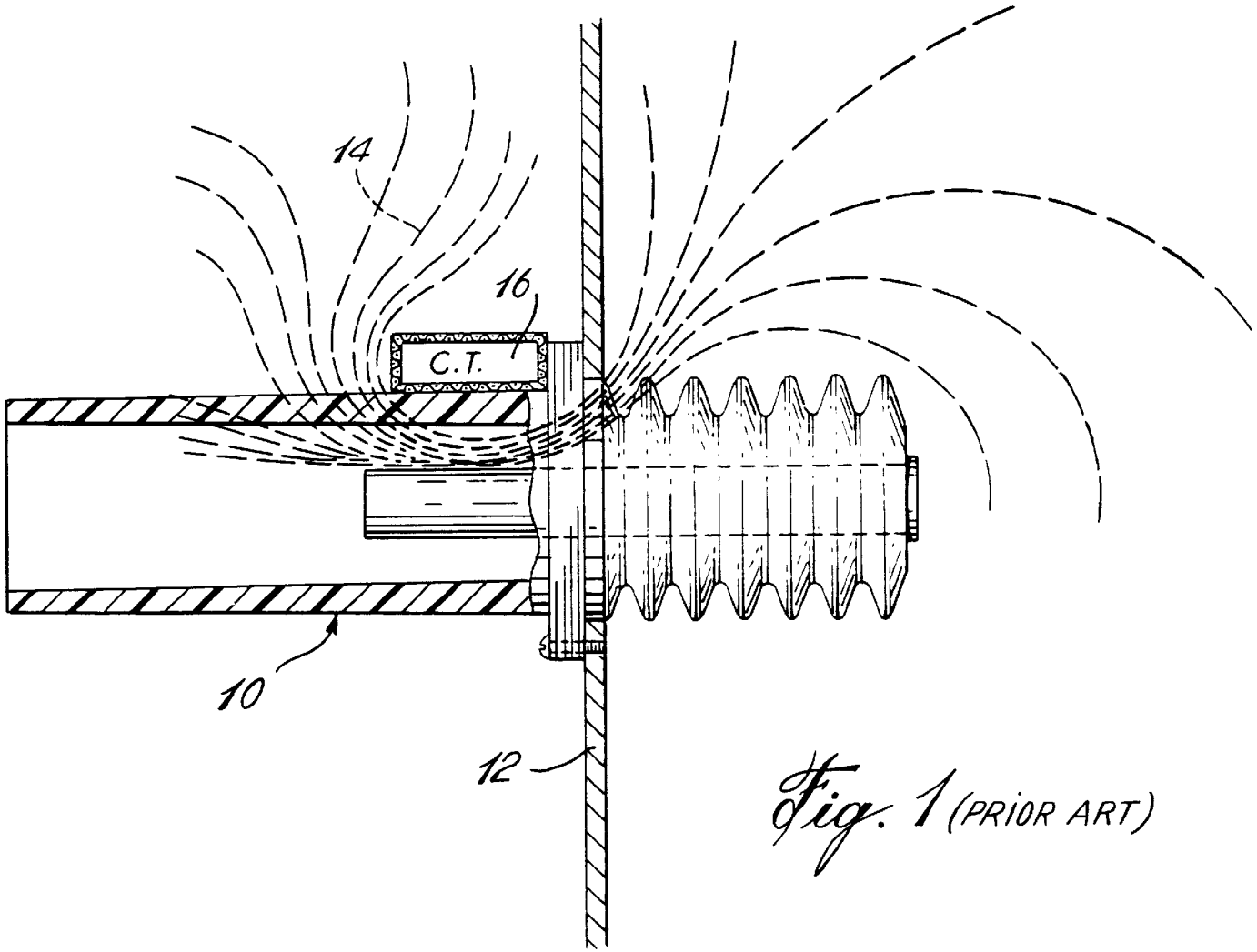
Fig. 1 (PRIOR ART)
FIG. 1, which is labelled "Prior Art", is a side elevational view, partly in section of a conventional high-voltage bushing illustrating the electric field lines.
Figure 2:
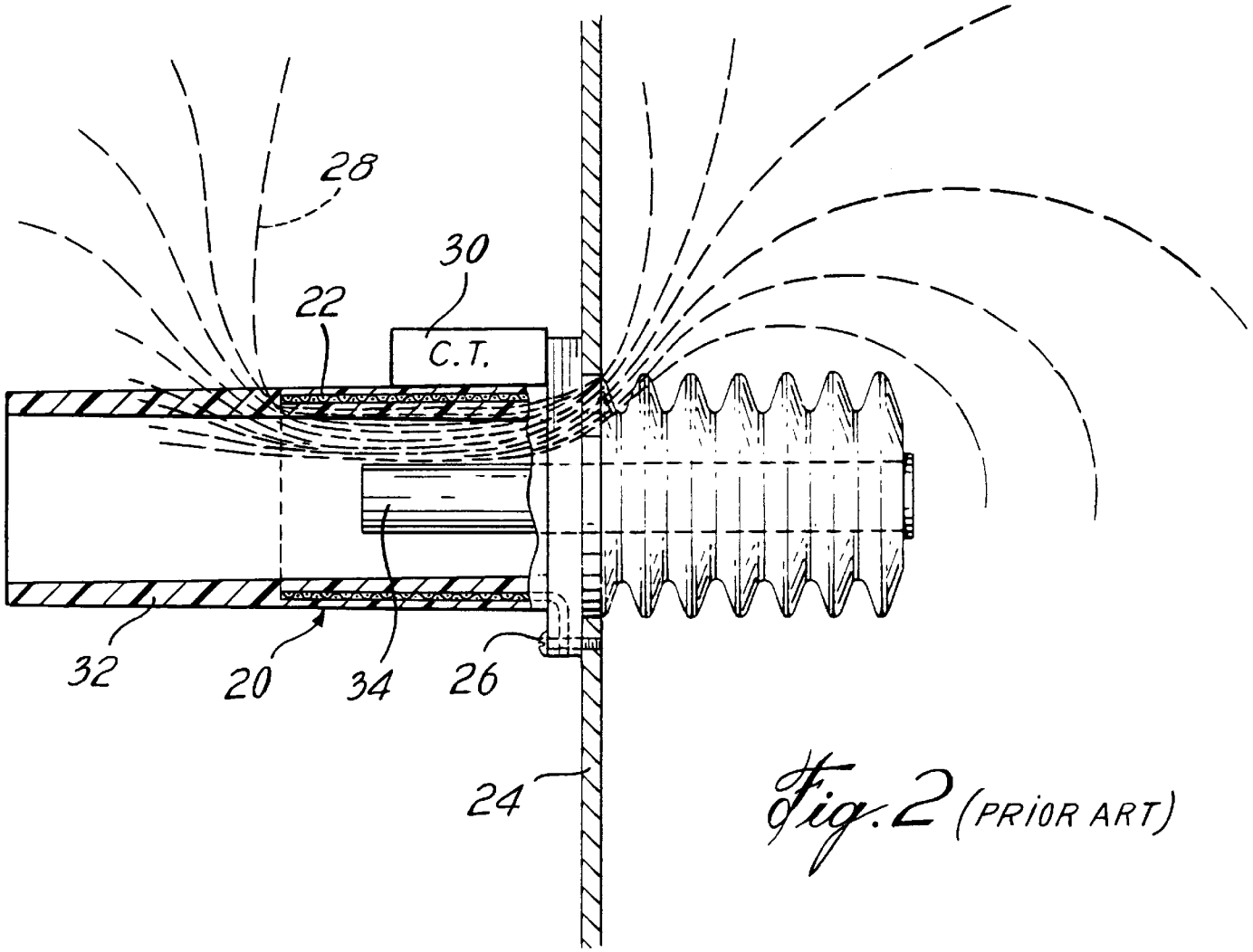
fig. 2 (PRIOR ART)
FIG. 2, which is labelled "Prior Art", is a side elevational view, partly in section of a conventional high-voltage bushing provided with an external shield electrically connected to the metallic enclosure, the electric field lines are also illustrated.
Figure 3:
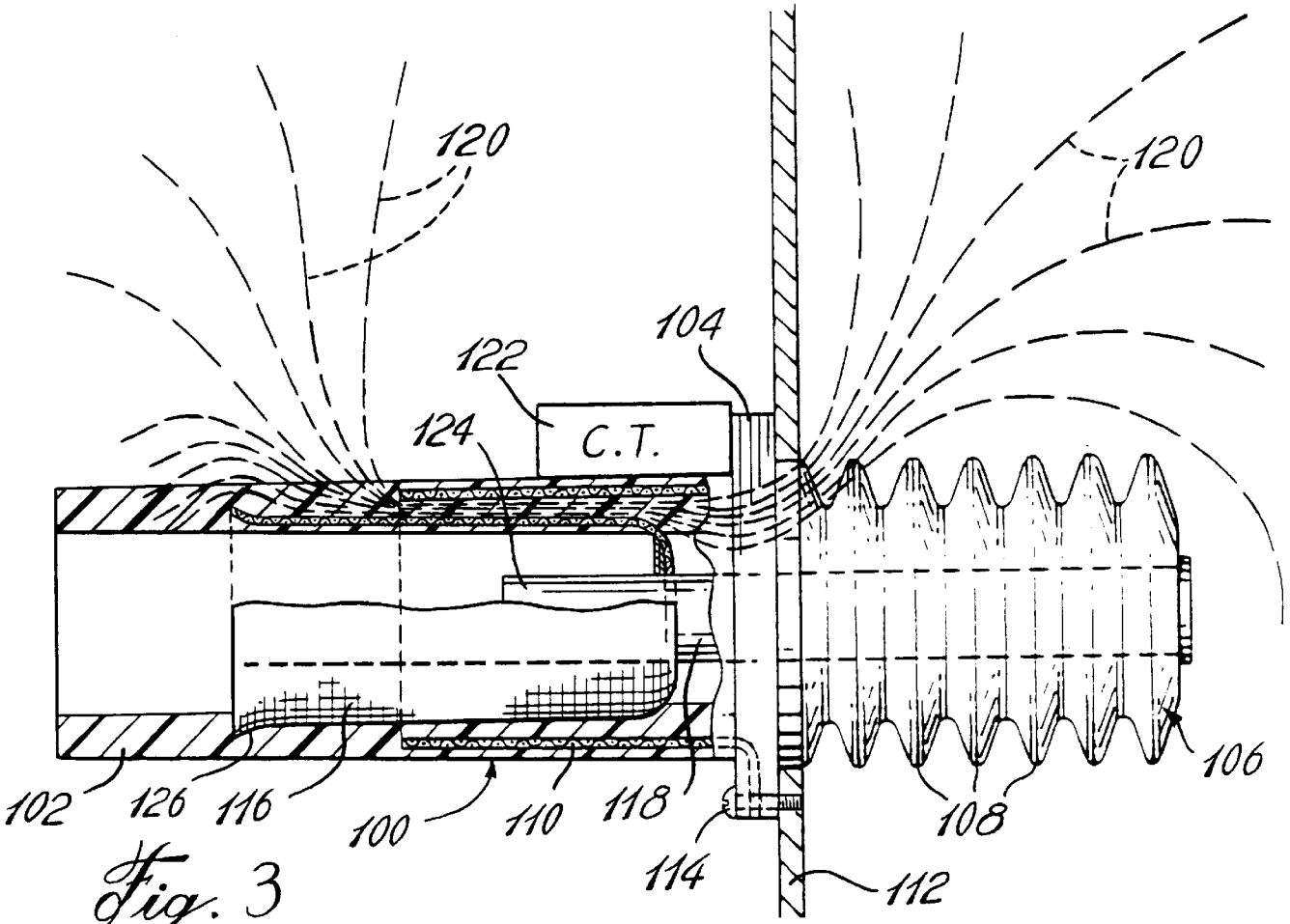
FIG. 3 a side elevational view, partly in section of a high-voltage bushing according to an embodiment of the present invention illustrating the electric field lines.

Turning now to FIG. 3 of the appended drawings, a bushing 100 according to an embodiment of the present invention will be described.

The bushing 100 defines an envelope under the form of a generally tubular body 102, integrally molded with a circular flange 104 and with an outer insulating shell 106. While the appended figures illustrate a series of rounded skirts 108, other profiles could be used as long as they define an adequate creepage distance.

The body 102, flange 104 and outer shell 106 are advantageously made of a very high quality dielectric material having low porosity levels such as, for example, a compound based on cycloaliphatic type epoxy resin having excellent tracking characteristics. This compound advantageously includes silica, wallastonite, silane type treatment agents, ATH-type (Alumina Trihydrate) or other fire-retardant agents, flexibilizing agents and chemical agents for controlling the viscosity and dispersing the fillers in the base resin. It is to be noted that it has been found advantageous to divide the mineral fillers equally between the resin and the hardener. Of course, other materials could be used as long as they present similar electrical and mechanical properties.

The bushing 100 includes an external shield 110 electrically connected to the conductive wall 112 via metallic fasteners 114 (only one shown) that are used to removably secure the bushing 100 to the wall 112. The shield 110 is generally tubular and is coaxially embedded in the tubular body 102 near the external surface thereof.

The bushing 100 further includes an internal shield 116 that is electrically connected to the conductor portion 118 of the bushing 100. The shield 116 is generally tubular and is coaxially embedded in the tubular body 102 near the internal surface thereof. The distal end 126 of the internal shield 116 flares outwardly to direct the electrical field away from the conductor 124.

The internal shield 116 is longer than the external shield 110 to prevent the electric field from being present in the air surrounding the conductor 124 by deflecting the electrical field away from the conductor 124.

Both the internal and external shields 116 and 110 are shown herein as braided metallic shields. Of course, other types of shields could be used, as long as they are adequately embedded in the body 102 so as to be coaxial.

As can be clearly seen from FIG. 3 of the appended drawings, the electric field (schematically represented by electric field lines 120) is adequately deflected from the base of the bushing 100, thereby allowing a conventional low voltage current transformer 122 to be used. Furthermore, the strong electric field is maintained in a single dielectric material, i.e. the dielectric material forming the body 102, therefore preventing high partial discharge levels in the air surrounding the conductor 124.

As will be apparent to one skilled in the art, the bushing 100 may advantageously be made with an Automatic Pressure Gelation (APG) system comprising a thin-film degassing mixer and a static flow mixer that ensure an adequate mixing of the different elements forming the epoxy resin based compound. Indeed, such a system allows an adequate control of the porosity levels of the finished bushing. Since APG systems are believed well known in the art, these systems will not be further described herein. Of course, the bushing 100 could be made through other processes such as, for example, a conventional vacuum casting system.

The bushing 100 is particularly suited to be used in switchgear systems where high performance and compact bushings are required.

It is to be noted that even though the conductor 124 is illustrated herein as having a circular cross-section, other cross-sections are possible without departing from the present invention.

Although the present invention has been described hereinabove by way of preferred embodiments thereof, it can be modified, without departing from the spirit and nature of the subject invention as defined in the appended claims.

What is claimed is:

1. A high-voltage bushing for insulating a conductor going through a conductive wall, said bushing comprising:

an envelope made of a dielectric material and having external and internal surfaces; said envelope being configured and sized to be mounted to the conductive wall and to receive the conductor;

an external shield embedded in said envelope near said external surface; said external shield being configured to be electrically connected to the conductive wall;

an internal shield embedded in said envelope near said internal surface; said internal shield being configured to be electrically connected to the conductor.

2. A high-voltage bushing as recited in claim 1, wherein said envelope includes a generally tubular body and wherein said internal and external shields are generally tubular.

3. A high-voltage bushing as recited in claim 2 further comprising a generally circular flange integrally formed with said generally tubular body.

4. A high-voltage bushing as recited in claim 3 further comprising an outer insulating shell made of dielectric material and integrally formed with said flange; said outer insulating shell defining a series of skirts.

5. A high-voltage bushing as recited in claim 3 wherein said external shield is connectable to the metallic wall via at least one metallic fastener going through said flange.

6. A high-voltage bushing as recited in claim 2, wherein said external shield and said internal shields are coaxial.

7. A high-voltage bushing as recited in claim 1, wherein said internal shield is a braided metallic shield.

8. A high-voltage bushing as recited in claim 1, wherein said internal shield is longer than said external shield.

9. A high-voltage bushing as recited in claim 1, wherein said external shield is a braided metallic shield.

10. A high-voltage bushing as recited in claim 1, wherein said internal shield has an outwardly flaring distal end.

11. A high-voltage bushing for insulating a conductor going through a metallic wall, said bushing comprising:

a generally tubular body made of a dielectric material; said generally tubular body being configured and sized to be mounted to the metallic wall and to receive the conductor; said generally tubular body having an external surface and an internal surface;

a generally circular flange made of dielectric material and integrally formed with said generally tubular body;

an outer insulating shell made of dielectric material and integrally formed with said flange; said outer insulating shell defining a series of skirts;

a generally tubular external braided metallic shield embedded in said body near said external surface; said external shield being configured to be electrically connected to the metallic wall via at least one metallic fastener used to mount said flange to the metallic wall; and a generally tubular internal braided metallic shield so embedded in said body near said internal surface as to be coaxial with said external shield; said internal shield being configured to be electrically connected to the conductor; said internal shield being longer than said external shield and being provided with an outwardly flaring distal end.

* * * * *